US009919859B2

(12) United States Patent
Rodriguez

(10) Patent No.: US 9,919,859 B2
(45) Date of Patent: Mar. 20, 2018

(54) CUP WITH PULL-THROUGH SLEEVE

(71) Applicant: Rachel Rodriguez, Fairfield, CA (US)

(72) Inventor: Rachel Rodriguez, Fairfield, CA (US)

( * ) Notice: Subject to any disclaimer, the term of this patent is extended or adjusted under 35 U.S.C. 154(b) by 145 days.

(21) Appl. No.: 15/012,654

(22) Filed: Feb. 1, 2016

(65) Prior Publication Data

US 2016/0340104 A1 Nov. 24, 2016

Related U.S. Application Data

(60) Provisional application No. 62/179,858, filed on May 21, 2015.

(51) Int. Cl.
*B65D 81/32* (2006.01)
*B65D 75/58* (2006.01)

(52) U.S. Cl.
CPC ..... *B65D 81/3238* (2013.01); *B65D 75/5827* (2013.01)

(58) Field of Classification Search
CPC ..... B65D 51/2807; B65D 51/2828; B65D 51/2842; B65D 51/2857; B65D 75/5827; B65D 81/32; B65D 81/3216; B65D 81/3233; B65D 81/3238; B65D 81/3244; B65D 81/3272
USPC ..... 206/219, 222
See application file for complete search history.

(56) References Cited

U.S. PATENT DOCUMENTS 3,043,424 A * 7/1962 Howard ..... B05C 17/00553 206/219
4,877,148 A * 10/1989 Larson ..... B65D 77/283 215/388
5,361,935 A * 11/1994 Sagucio ..... A47G 19/2266 215/229
5,567,455 A * 10/1996 Alsbrook, Sr. ..... A21C 15/007 426/115
2003/0160067 A1* 8/2003 Gupta ..... A61J 1/2093 222/209
2004/0081728 A1* 4/2004 Haermeyer ..... B65D 81/3216 426/124

FOREIGN PATENT DOCUMENTS

GB 752750 A * 7/1956 ..... B65D 51/2857

* cited by examiner

*Primary Examiner* — Anthony Stashick
*Assistant Examiner* — Mollie Impink
(74) *Attorney, Agent, or Firm* — Dergosts & Noah LLP; Todd A. Noah

(57) ABSTRACT

A food package for wet and dry ingredients with a pull-through sleeve. A container is filled with a wet food product. A sleeve filled with a dry food product is enclosed within the container by having the bottom end of the sleeve affixed to the bottom of the container and the top end of the sleeve extending through a narrow slot in the lid of the container. The sleeve is formed with perforations along its length in a helix. When top end of the sleeve is pulled up through the narrow slot in the lid of the container, the sleeve is stretched and the perforations break following the helical pattern thereby releasing the dry food product from the sleeve into the wet food product in the container.

7 Claims, 7 Drawing Sheets

CUP WITH PULL-THROUGH SLEEVE

CROSS-REFERENCE TO RELATED APPLICATIONS

This application claims the priority under 35 U.S.C. § 119 or the Paris Convention of U.S. Provisional Patent Application No. 62/179,858, filed on May 21, 2015, the entire contents of which is incorporated herein by reference as if set forth in full herein.

TECHNICAL FIELD

This disclosure relates to food packaging, and more particularly, to a container that enables separating dry ingredients from wet ingredients with a perforated sleeve that may be pulled from the container to break the perforations and combine the ingredients.

BACKGROUND

Disposable packaging containing ready-to-eat food items is sold in grocery stores, airport shops, coffee shops, fast food restaurants and the like. One common type of food package provides the ability to hold a high moisture item, such as yogurt, and a low moisture item, such as granola, in the same package. Thus, the consumer can purchase a single package having both food items instead of buying a separate package of yogurt and a separate package of granola, for example. However, one example of yogurt/granola packaging requires the consumer to open more than one container, and another example of yogurt/granola packaging requires the consumer to fold one side of the container over the other side and then reposition the first side before combining the granola with the yogurt.

In general, it is often desirable to combine a food item having a high moisture content, e.g., a wet ingredient, with a food item having a low moisture content, e.g., a dry ingredient. However, if the low moisture food item is combined with the high moisture content food for too long a period of time before consumption, the low moisture item may become soggy and less desirable to eat. Therefore, it is preferable that such wet and dry ingredients not be combined with each other until just prior to eating. Examples of these food items are yogurt, kefir, cottage cheese or milk combined with granola, oats or other cereals. In particular, consumers prefer that yogurt and granola be combined just prior to consumption so that the granola is kept dry and crunchy.

There are several methods known in the prior art for packaging high moisture content food items, such as yogurt, with low moisture content food items, such as granola. For example, U.S. Patent Publication No. 2011/0303678 describes a parfait cup having domed lid with at least three individual containers within a single package. The individual containers are kept separate until the consumer wants to combine them.

U.S. Pat. No. 9,067,713 provides a separate pouch containing granola which must be opened and then mixed into the yogurt just prior to eating. U.S. Pat. No. 8,591,976 also provides a separate, sealed pouch to hold granola. The pouch may be affixed to the rim or lid of a jar, cup, soda can, or the like. U.S. Pat. No. D699,571 illustrates a parfait cup having a domed lid with a separate container as part of the lid for storing the granola.

U.S. Patent Publication No. 2007/0125777 describes a compact yogurt container having stackable compartments wherein a separate bottom compartment may contain a variety of accompaniments for yogurt, which is contained in the top compartment. U.S. Patent No. 2008/0245682 also provides stacked compartments. The food items are placed in the bottom compartment, which is then heat-sealed. A second compartment is stacked on top of the first compartment and covered. A tab extends upwardly through the top of the first compartment to be grasped from above the second compartment to open both compartments.

U.S. Patent Publication No. 2011/0170806 describes a side by side construction of parallel longitudinal compartments, which can be filled with different food items. A tear strip is provided on the top of each compartment to open each compartment and dispense the contents.

The disadvantage associated with most common types of food packaging is that a consumer needs to open the lid, remove the sealed container or pouch of granola, open the seal, and pour the granola into the yogurt in order to eat the yogurt and granola together. Therefore, it would be desirable to simplify the packaging to both maintain and then mix the separate ingredients with less action steps required on the part of the consumer.

DETAILED DESCRIPTION

A food package is disclosed that keeps wet and dry ingredients separate until the consumer is ready to mix the ingredients. A sleeve is affixed within the container and includes a tab extending through a narrow slot in the top of the container. The container is filled with a wet food product surrounding the sleeve, and the sleeve is filled with a dry food product. The sleeve is formed with one or more perforation patterns. The tab is pulled up through the narrow slot thereby also pulling up the sleeve, which causes the perforations to break along the pattern from top to bottom. As the perforations break and the sleeve is pulled through the narrow slot, the sleeve straightens out, and the narrow slot acts to scrape the wet and dry food product off of the sleeve and into the container. When the sleeve is fully extended, it breaks free from the bottom of the container to completely release the dry food product into the container to mix with the wet food product.

Figure 1:
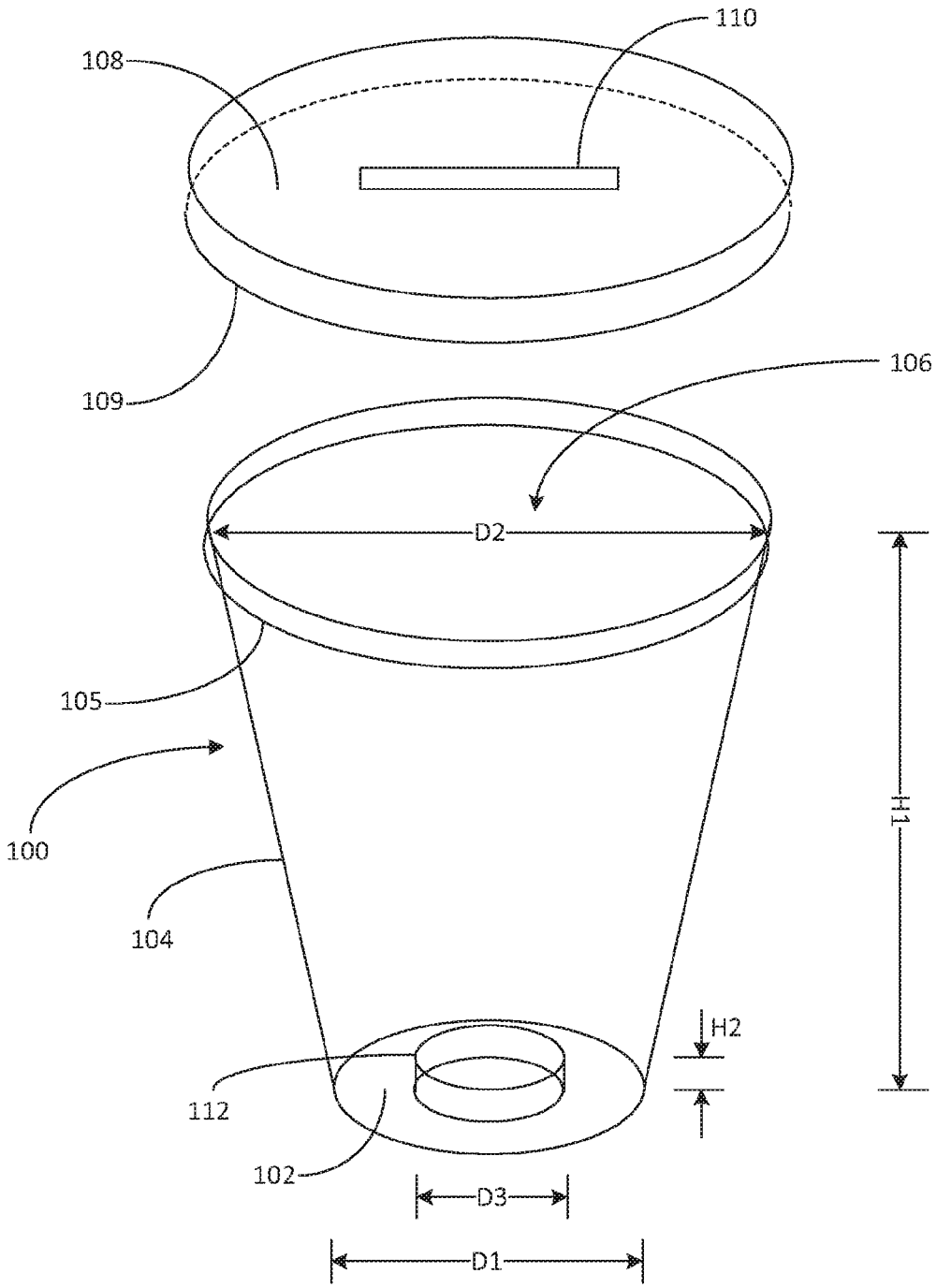
FIG. 1 is a perspective view of a food container with a removable top.
Figure 2:
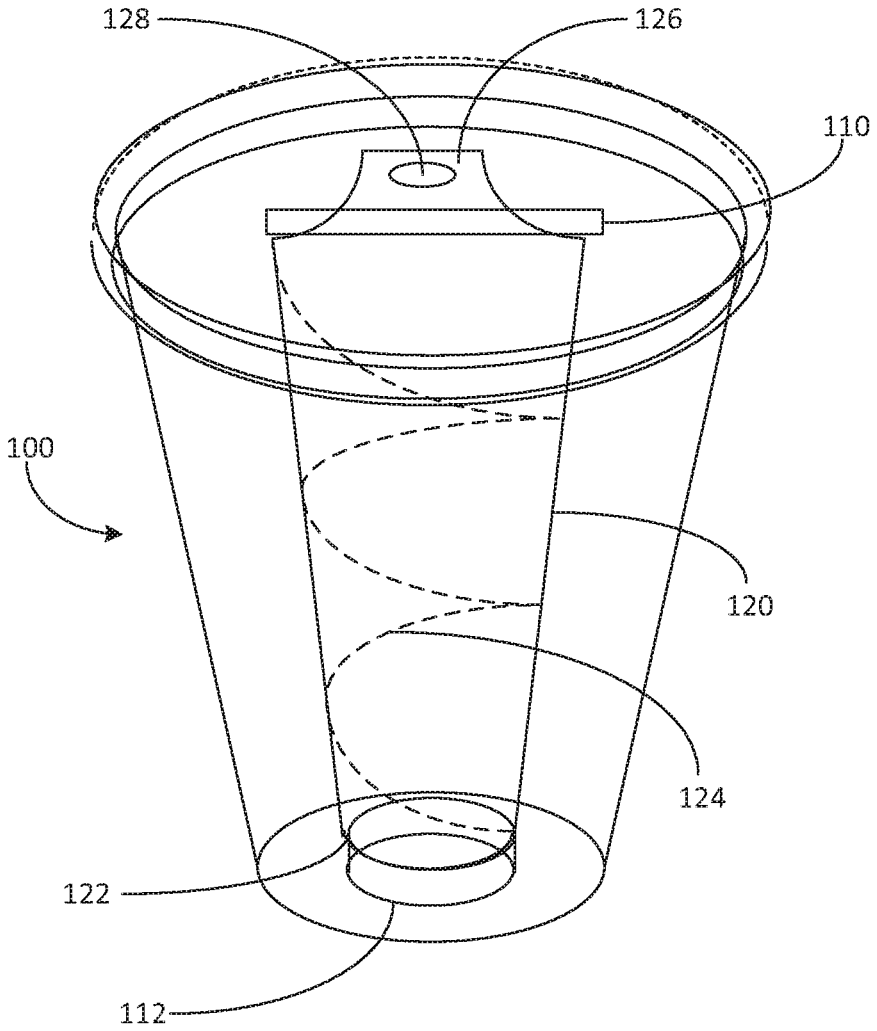
FIG. 2 is a perspective view of the food container of FIG. 1 having one embodiment of a sleeve affixed within the container.

FIG. 1 illustrates one embodiment of a container 100 configured to have a pull-through sleeve 120 (shown in FIG. 2). The container 100 is formed as an inverted conical frustrum, similar to a conventional beverage cup, with a closed base 102 having a first diameter D1, and conical sides 104 extending upward from the base with a lip 105 formed at the top end of the sides. The container 100 also has an open top 106 with a second diameter D2 larger than the first diameter D1 of the closed base 102.

The container 100 includes a removable lid 108 for covering the open top 106, with an edge portion 109 that is configured to easily snap on and off of the lip 105 of the container. The removable lid 108 also includes a narrow slot opening 110. In this embodiment, the slot 110 is centrally located on the lid 108, but the slot could be formed in other locations on the lid.

A small cylindrical cup 112 is affixed to the base 102 on the inside of container 100 as an attachment device for the sleeve 120, as discussed below with reference to FIG. 2. The interior cup 112 has a third diameter D3 that is smaller than the first diameter D1 of the base. In one embodiment, the diameter D1 of the base 102 is 2¼ inches; the diameter D2 of the lid 108 is 3½ inches; the diameter D3 of the interior cup 112 is 1½ inches; the height H1 of the container is 4½ inches; and the height H2 of the interior cup is ¾ inch.

The container 100 may be molded from plastic or formed from other suitable materials. Although FIG. 1 illustrates container 100 as a conical cup, the container may be formed in different geometrical shapes with different volumes, including a cylinder, a square cube, a rectangular prism, etc. Further, the sleeve attachment device 112 could be configured differently and affixed to the sides 104 or off-center on the base 102 in accord with different sleeve embodiments.

In one embodiment, the base 102 of the container 100 may be formed with an integrated interior cup 112. For example, the base 102 may be formed as a convex or concave surface having a circular or square lip molded as part of the surface, where the lip is deep enough to receive and support the sleeve 120.

FIG. 2 shows a sleeve 120 enclosed within the container 100. In one embodiment, the sleeve 120 is formed as an inverted conical frustrum similar to the container, but also could be formed as a cylindrical section or other geometrical shape that is smaller in volume than the container 100. The sleeve 120 has a bottom or base portion 122 that is inserted into and affixed to the interior cup 112 within the container 100. For example, the bottom portion 122 of the sleeve 120 may be affixed with the interior cup 112 by a food grade adhesive such as gelatin or wheat paste.

Figure 3A:
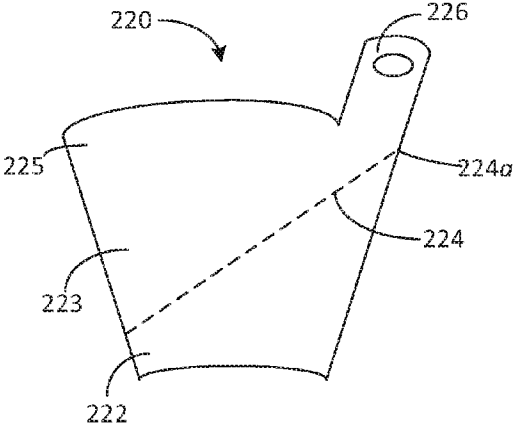
FIGS. 3A-3C illustrate examples of two-dimensional layouts for the sleeve shown in FIG. 2.
Figure 3B:
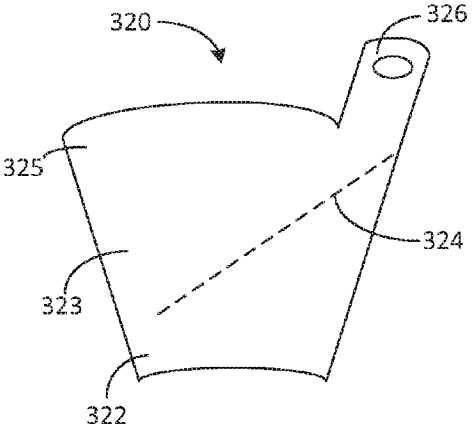
Figure 3C:
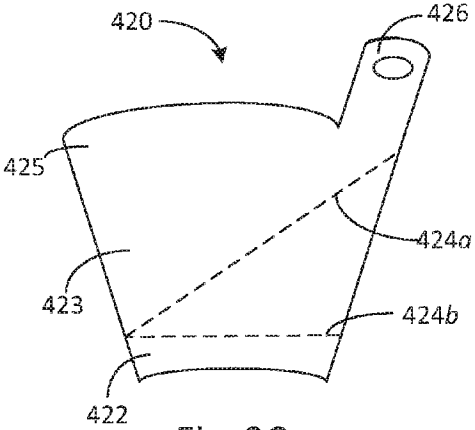

The sleeve 120 includes perforations 124 formed around a substantial portion of the sleeve. Various perforation patterns can be formed, and several examples are illustrated in FIGS. 3A-3C and described below. A top portion 126 or tab of the sleeve 120 above the perforated section is formed to be substantially straight and flat in order to extend through the narrow slot 110 formed in the removable lid 108. A hole 128 can be formed in the tab 126 of the sleeve 120 to facilitate gripping the tab and pulling it through the narrow slot 126.

In an embodiment, the sleeve 120 is made from a flexible plastic material and has a bottom diameter of 1.45 inches, i.e., just smaller than the diameter D3 of the interior cup 112 in order to fit snugly within the interior cup. The sleeve 120 is approximately 5 inches tall including a 2 inch straight section at the top that includes the tab 126 extending through the narrow slot 110 of the lid 108. The remaining 3 inch portion at the bottom of the sleeve 120 inserts about ¾ inch into the interior cup 112, and the interior cup supports the sleeve to help it stand upright in the container. In this embodiment, the sleeve holds approximately 3 ounces of granola.

While the dimensions described with regard to this embodiment are exemplary, one skilled in the art would understand that other embodiments could have different dimensions consistent with the needs of a particular application.

In use, the sleeve 120 is affixed within the container 100 when the container is manufactured, and a large number of containers are shipped to a food packing plant. At the food packing plant, the top 108 is removed, and the sleeve 120 is filled with a dry food ingredient, such as granola. The container 100 is then filled with a wet food ingredient, such as yogurt, to surround the sleeve 120. Finally, the top 108 is secured on the container with the tab 126 sticking up through the slot 110. The packaged product is then distributed to retail stores for purchase by consumers.

When a consumer buys the package and wants to consume the products contained therein, the tab 126 is pulled up through the narrow slot 110 in the lid 108. This causes the sleeve 120 to be pulled up with the tab 126 through the slot 110 thereby stretching the sleeve and breaking the perforations 124 from the top down to the bottom. As the perforations 124 break, the dry ingredients within the sleeve are released into the wet ingredients in the container. Further, if the slot 110 is sufficiently narrow, the dry ingredients are scraped from the interior portion of the sleeve and the wet ingredients are scraped from the exterior portion of the sleeve by the lid 108 adjacent the slot. The consumer may choose to further mix the ingredients, or not.

FIGS. 3A-3C illustrate several examples of two-dimensional layouts for the sleeve 120 of FIG. 1 to be formed as an inverted conical frustrum. In FIG. 3A, sleeve layout 220 has a bottom portion 222 that is free of perforations and shaped as a half-circle; a middle portion 223 having perforation pattern 224; a top portion 225 shaped as a half-circle following the same radius as the half-circle of the bottom portion; and a tab portion 226 extending from the top portion. The sides of the sleeve layout 220 extend from the bottom portion 222 to the top portion 225 at an acute angle.

In the embodiment of FIG. 3A, the perforation pattern 224 is a straight line angled from the edge of the layout 220 at the top right corner near the tab portion 226 to the edge of the layout at the bottom left corner near the bottom portion 222. By starting the perforation pattern 224 at the edge of the sleeve layout 220 near the tab 226, the perforation pattern begins to break apart at point 224*a* as soon as the tab is lifted through the slot 110, and the perforation pattern continues to break along the line as the tab continues to be pulled, ultimately causing most of the sleeve to be removed through the slot, but leaving a portion of the sleeve fixed within the cup 112.

In FIG. 3B, the sleeve layout 320 is similar to the sleeve layout 220 of FIG. 3A, with a bottom portion 322, a middle portion 323, a top portion 325, and a tab portion 326. However, in this embodiment, the perforation pattern 324 does not extend all the way to the bottom left corner. Thus, when the perforation pattern 324 is completely broken, the sleeve 320 is not completely free as it is still held in place in the bottom cup 112 of container 100. However, by continuing to exert upward pull on the tab 326, the sleeve 320 breaks free of its adhesive connection to the cup 112 and can be drawn entirely through the slot 110.

FIG. 3C illustrates yet another sleeve layout 420 similar to sleeve layouts 220 and 320, with a bottom portion 422, a middle portion 423, a top portion 425, and a tab portion 426. In sleeve layout 420, perforation pattern 424*a* is a straight line pattern angled from the edge of the layout 420 at the top right corner near the tab portion 426 to the edge of the layout at the bottom left corner near the bottom portion 422, just as in sleeve layout 220. However, sleeve layout 420 includes a second perforation pattern 424*b* as a straight line pattern running across the layout from its edge at the bottom left corner near the bottom portion 422 to the edge at the bottom right corner near the bottom portion. Thus, when the first perforation pattern 424*a* is completely broken, a continued upward pull on the tab 426 causes the second perforation pattern 424*b* to also break thereby causing the sleeve 420 to come completely free and allowing it to be drawn entirely through the slot 110.

Figure 4B:
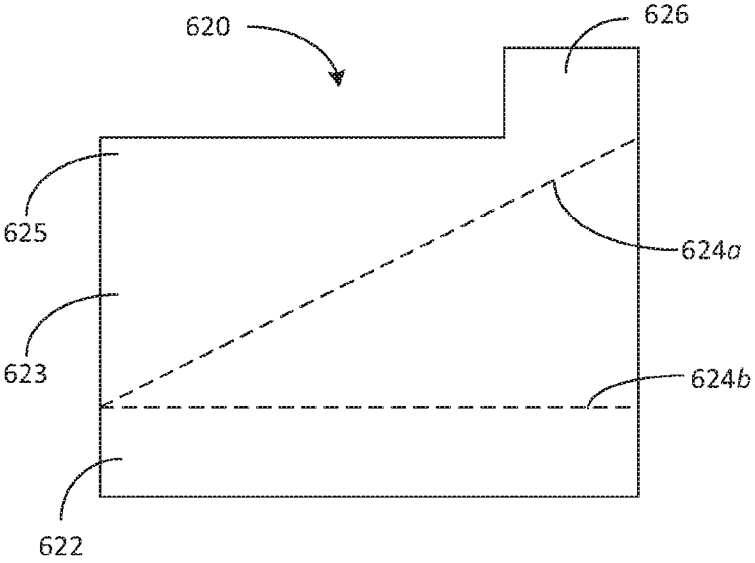
FIGS. 4A-4B illustrate additional examples of two-dimensional layouts for the sleeve shown in FIG. 2.
Figure 4A:
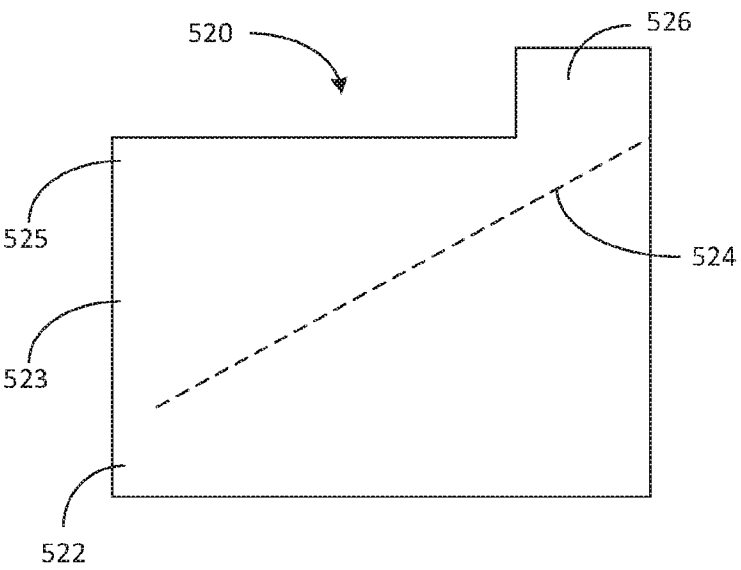

FIGS. 4A-4B illustrate examples of two-dimensional layouts for the sleeve 120 of FIG. 1 to be formed as an cylindrical structure. FIG. 4A is a rectangular sleeve layout 520 with a bottom portion 522 that is free of perforations; a middle portion 523 having perforation pattern 524; a top portion 525; and a tab portion 526 extending from one side of the top portion. The perforation pattern 524 is a straight line angled from the edge of the layout 520 at the top right corner near the tab portion 526 but not extending all the way to the edge of the layout at the bottom left corner. Thus, when the perforation pattern 524 is completely broken, the sleeve 520 is still held in place in the bottom cup 112 of container 100, but continued upward pull on the tab 526 causes the sleeve to break free of its adhesive connection to the cup 112 and allows the sleeve to be drawn entirely through the slot 110.

FIG. 4B is a rectangular sleeve layout 620 similar to sleeve layout 520, with a bottom portion 622, a middle portion 623, a top portion 625, and a tab portion 626. A first perforation pattern 624*a* is a straight line pattern angled from the edge of the layout 620 at the top right corner near the tab portion 626 to the edge of the layout at the bottom left corner near the bottom portion 622. A second perforation pattern 624*b* is a straight line pattern running across the layout from its edge at the bottom left corner near the bottom portion 622 to the edge at the bottom right corner near the bottom portion. As in the layout 420 shown in FIG. 3C, when the first perforation pattern 624*a* is completely broken, a continued upward pull on the tab 626 causes the second perforation pattern 624*b* to break thereby causing the sleeve 620 to come completely free and allowing it to be drawn entirely through the slot 110.

Figure 5B:
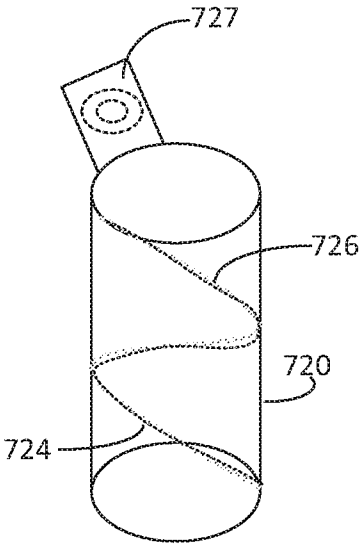
FIG. 5B is a perspective view illustrating the sleeve of FIG. 5A.
Figure 5A:
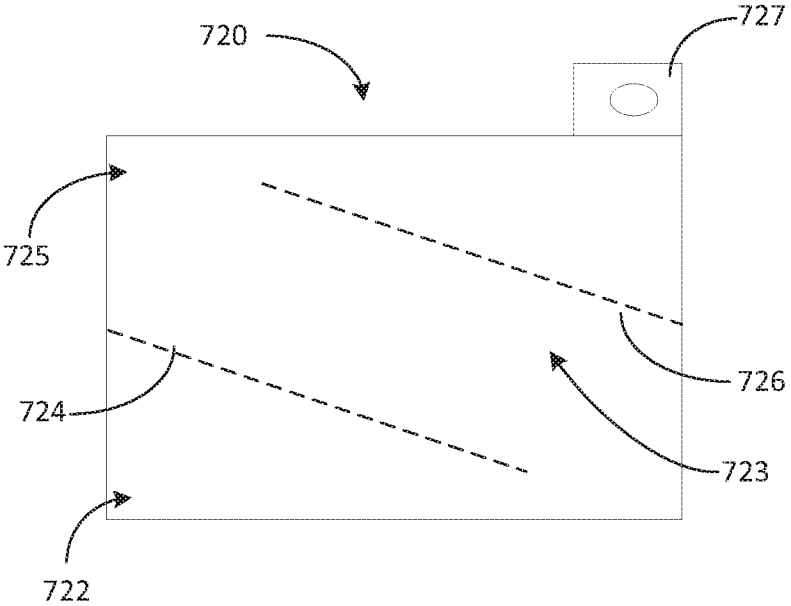
FIG. 5A illustrates an example of a two-dimensional layout for a sleeve.

FIG. 5A illustrates another example of a two-dimensional layout 720 for the sleeve, and FIG. 5B illustrates the layout formed as a cylindrical structure. Sleeve layout 720 is a rectangular pattern having a bottom portion 722 that is free of perforations; a middle portion 723 having a first perforation pattern 724 and a second perforation pattern 726; a top portion 725 having the second perforation pattern 726 extending into the top portion; and a tab portion 727 extending from the top edge of the layout 720 at the top portion 725.

The first perforation pattern 724 is a straight line pattern that runs from approximately the center of the left edge of layout 720 at a downward angle of about 45 degrees to past the midpoint of the layout. The second perforation pattern 726 is a straight line pattern that runs from approximately the center of the right edge of layout 720 at an upward angle of about 45 degrees to past the midpoint of the layout. The perforation patterns 724, 726 meet each other at the edges of the layout 720 when the layout is rolled into a cylindrical structure. When the tab is pulled, the second perforation pattern 726 is broken first, and a continued upward pull on the tab 727 causes the first perforation pattern 724 to also break thereby causing the sleeve 720 to come completely free and allowing it to be drawn through the narrow slot in the container lid.

Figure 5C:
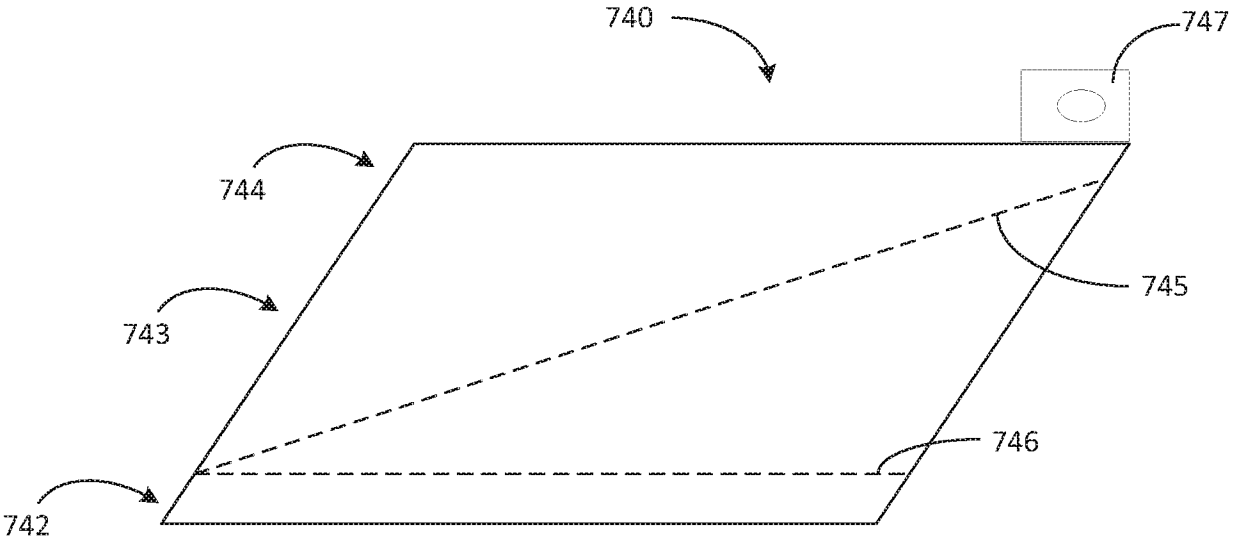
FIG. 5C illustrates another example of a two-dimensional layout for a sleeve.

Yet another example of a two-dimensional layout 740 for a sleeve is illustrated in FIG. 5C. Sleeve layout 740 is a parallelogram pattern having a bottom portion 742, a middle portion 743, a top portion 744, and a tab portion 747. The layout 740 is rolled into a cylinder such that the right edge will be coupled to the left edge to form the cylinder. A first perforation pattern 745 is a straight line pattern angled from the right edge of the layout 720 on the top portion 744 near the tab 747 at a downward angle of approximately 45 degrees through the middle portion 743 to the bottom left corner of the layout, above the bottom portion 742. A second perforation pattern 746 is a straight line pattern running across the layout 740 from its edge at the bottom left corner near the bottom portion 742 to the edge at the bottom right corner near the bottom portion. As in FIGS. 3C and 4B, when the first perforation pattern 745 is completely broken, a continued upward pull on the tab 747 causes the second perforation pattern 746 to break across the bottom of the layout 740 thereby causing the sleeve to come free so that can be drawn through the slot in the lid.

Figure 6:
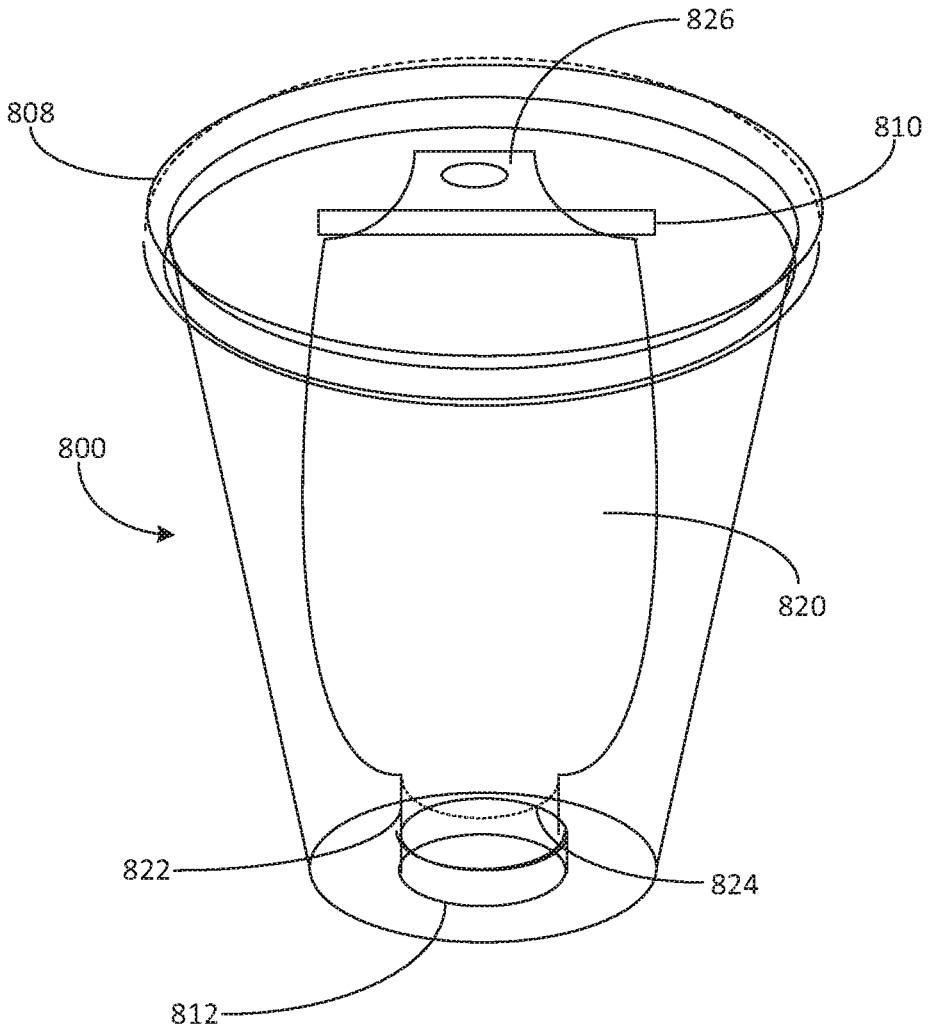
FIG. 6 is a perspective view of the food container of FIG. 1 having an alternative embodiment of a sleeve affixed within the container.

In an alternative embodiment shown in FIG. 6, the container 800 includes a sleeve 820 that is balloon-shaped with a single perforation 824 formed at the bottom portion 822 of the sleeve. The bottom 822 of sleeve 820 inserts into the interior cup 212, just as in FIG. 2. However, when the tab portion 826 of the sleeve 820 is pulled up through the slot 810 of the container lid 808, the perforation 824 is broken and the dry product inside the sleeve is left behind in the container 800 through the opening formed in the bottom of the sleeve by the broken perforation. Further, the narrow slot 810 compresses the sleeve 820 as it is pulled through the slot and forces the dry ingredients within the sleeve to be pushed out of the bottom of the sleeve and into the wet product in the container 800.

The skilled artisan will appreciate that variations may be made in the construction and materials of the disclosed embodiments, all without departing from the scope of the disclosure, which is defined by the following claims.

The invention claimed is:

1. A food package for wet and dry ingredients, comprising:

a container having a lid, a slot in the lid, and a first volume for filling with a first food product; and a sleeve having a length and a second volume for filling with a second food product, the sleeve having a first end that extends through the slot in the lid, perforations formed along the length of the sleeve in a helix and a second end that is releasably coupled to a bottom portion of the container;

wherein when the container is filled with a first food product and the sleeve is filled with a second food product, pulling the first end of the sleeve straightens the sleeve that will cause the perforations to break beginning at the first end of the sleeve and continuing along the entire length of the sleeve to the second end of the sleeve thereby releasing the second food product within the sleeve into the first food product in the container, the sleeve being released from the bottom portion of the container after the sleeve is fully extended and the perforations along the entire length of the sleeve are broken.

2. The food package of claim 1, wherein the narrow slot scrapes the dry food product from an interior surface of the sleeve and into the container as the first end of the sleeve is pulled up through the narrow slot.

3. The food package of claim 1, wherein the narrow slot scrapes the wet food product from an exterior surface of the sleeve and into the container as the first end of the sleeve is pulled up through the narrow slot.

4. The food package of claim 1, further comprising:

a sleeve attachment device affixed within the container, the sleeve is coupled to the sleeve attachment device.

5. The food package of claim 1, further comprising a releasable coupling between the second end of the sleeve and the bottom of the container, such that when the perforations are fully broken by stretching the sleeve the sleeve breaks free from the releasable coupling.

6. The food package of claim 5, the removable coupling is a food grade adhesive.

7. The food package of claim 5, the second end of the sleeve is affixed to the bottom portion of the container, and the removable coupling is a set of second perforations formed laterally around the sleeve above the second end.

* * * * *